US006098811A

United States Patent [19]

Schaefer

[11] Patent Number: 6,098,811

[45] Date of Patent: Aug. 8, 2000

[54] GRIZZLY SCREENING APPARATUS

[75] Inventor: David J. Schaefer, Yankton, S. Dak.

[73] Assignee: Astec Industries, Inc., Chattanooga, Tenn.

[21] Appl. No.: 08/690,478

[22] Filed: Jul. 31, 1996

[51] Int. Cl.[7] ..... B07B 1/49

[52] U.S. Cl. ..... 209/395; 209/408

[58] Field of Search ..... 209/309, 320, 209/322, 325, 326, 393, 395, 405, 408, 409

[56] References Cited

U.S. PATENT DOCUMENTS

| | | | |
|---|---|---|---|
| 4,956,078 | 9/1990 | Magerowski et al. | 209/395 X |
| 5,398,819 | 3/1995 | Cormack et al. | 209/395 X |

FOREIGN PATENT DOCUMENTS

| | | | |
|---|---|---|---|
| 1570791 | 6/1990 | U.S.S.R. | 209/395 |

*Primary Examiner*—Tuan N. Nguyen
*Attorney, Agent, or Firm*—Moore & Hansen

[57] ABSTRACT

A grizzly screen apparatus has a screen of grizzly bars having first ends mounted in a transverse end member and second ends placed in a slotted comb member having alternating shallow and deep bed slots. The screen is rotatable about a transverse axis whereby the second ends of secondary grizzly bars in the deep bed slots are lowered relative to the second ends of grizzly bars in the shallow bed slots, resulting in simultaneous steepening of the screen and an increase of the interbar distance, to remove obstructing oversize objects from the screen. Each grizzly bar has a transverse lock bar at the first end which retains the grizzly bar within an aperture in the transverse end member without bolts or other fasteners. Obstructions on the grizzly screen may be cleared without the use of manually operated tools, and if desired, may be cleared by remote control.

38 Claims, 4 Drawing Sheets

GRIZZLY SCREENING APPARATUS

BACKGROUND OF THE INVENTION

This invention relates generally to a screening apparatus for separating solid materials by size. More particularly, this invention pertains to an improved grizzly screen apparatus for separating rocks, concrete, asphalt and other objects by size.

A separation apparatus known as a "grizzly" or "grizzly screen" has been known for many years. Such screens comprise a series of strong, parallel, spaced apart bars that are used to separate large rocks and other debris from material of smaller size. Such screens provide a relatively coarse size separation and are typically used to separate oversize rocks from smaller materials, such as in a gravel plant, a road construction project or quarry.

Typically, a grizzly screen will utilize parallel steel bars which are in a fixed position relative to each other and be spaced about 4–6 inches apart. Thus, the grizzly apparatus will separate rocks and other materials having a dimension greater than the bar spacing from smaller sized materials passing through the screen.

As unsorted debris is dropped onto the screen, objects which are smaller than the bar spacing slip between the bars into a receiving bin, flume, truck or conveyer. Objects larger than the bar spacing cannot slip between the bars arid will roll and/or slide to the lower end of the screen and fall therefrom. The plane of the grizzly bars may vary depending upon the application, but is typically at an angle of about 20 degrees to encourage such rolling and sliding of the larger objects.

A major problem with grizzly screens is that objects having at least one dimension only slightly larger than the bar spacing tend to become jammed between the bars of the screen. These obstructions prevent or retard the discharge of subsequently encountered objects, and the screening capacity increasingly deteriorates. Often such jammed objects require manual removal from the screen using a crowbar, sledge hammer and the like.

It is known to manufacture a grizzly screen whose bars have tapered cross-sections wherein the bottom of each bar is narrower than the top, thus increasing the likelihood that objects passing downward through the screen will not become jammed between the bars. This innovation does not, however, prevent all jamming of the screen and serious jamming problems still occur.

It is desirable to reduce the amount of manual contact which an operator must devote to the removal of jammed obstructions from the grizzly screen. Typically each removal effort requires the operator to remove four to six inch or larger rock from the bars with a heavy crowbar or sledge hammer, and any reduction of such manual clearing work decreases the risk of accident or injury. In addition, some materials sorted by the screen may be of a toxic nature, and it is desirable to reduce manual handling of and close operator exposure to such materials as much as possible.

Still a further shortcoming of existing grizzly screens is that the bars forming such screen are usually rigidly connected to the screen frame and require considerable effort and tools to remove or replace damaged or worn bars. It is desirable to provide a positive attachment apparatus for the screen bars which also allows easy removal and replacement of the bars without tools.

An object of the invention is an improved grizzly screening apparatus which effectively provides for rapid and easy removal of oversize materials which become jammed between the grizzly bars and obstruct the screen.

An additional object of the invention is a grizzly screening apparatus which has a reduced down time for dislodging obstructions from the screen.

A further object of this invention is a grizzly screening apparatus having a controllable movement whereby obstructions may be freed without manual intervention with tools.

Another object of the invention is a grizzly screening apparatus in which obstructing objects may be removed without significantly changing the separation or tolerance characteristic of the screen.

Another object of the invention is a grizzly screening apparatus in which worn or bent bars may be easily and quickly replaced with minimal use of tools.

BRIEF SUMMARY OF THE INVENTION

A grizzly screening apparatus includes left and right side frame members which are interconnected by a transverse end member and at least one transverse crossbar fixed to the side frame members. Mounted on the frame and comprising a screen are a plurality of parallel solid metal, circular cross-section grizzly bars. Each grizzly bar has a first end which is pivotally held in a passageway in the transverse end member and so positioned therein as to prevent its unintended removal. The opposite, free ends of the grizzly bars interact with a stationary transverse comb member which comprises a vertically slotted horizontal member. The comb member has alternating deep bed and shallow bed slots into which the second ends of the grizzly bars are received. The grizzly screen is typically positioned above a receptacle such as a bin, flume, truck or conveyor. The screen is pivotable about a horizontal axis near its discharge end so that its transverse end member and the first ends of the grizzly bars attached thereto may be pivotally moved between a sorting position and a raised clearing position.

In the sorting position, where the screening operations are conducted, all of the grizzly bars have their second ends at about the same elevation, i.e. all grizzly bars are supported by at least one crossbar and are positioned near the upper ends of the slots of the comb member to about the same depth, in the comb member slots, regardless of the slot depth. In the raised clearing position, the second ends of some grizzly bars engage the shallow slot beds of the comb member while the second ends of other grizzly bars drop to a lower level in the deep slots. Thus, the second ends of the grizzly bars diverge from one another in elevation and spacing distance as the screen is pivoted upwardly to the clearing position. The second ends of the grizzly bars are held within the deep bed slots and shallow bed slots, and thus each bar moves in a vertical plane. As the screen moves from sorting to clearing position, the horizontal spacing between the adjacent grizzly bars remains essentially constant, while the actual spacing between bars increases as the second ends of the bars diverge as the angle of the screen with the horizontal is increased.

The pivot axis of the grizzly screen is so located toward the second ends of the grizzly bars that pivotal movement of the screen upwardly from a lower position results in engagement of some of the grizzly bars with the bottom of the shallow slots of the comb member, while alternate grizzly bars continue to drop to a lower level in the deep slots. As a result, the bars in the deep slots have their second ends lower than bars in the shallow slots, and the actual spacing between the second ends of adjacent bars increases. Because of this vertical bar movement and the accompanying increase in spacing, obstructions caught between the grizzly bars will come loose from the bars and roll or slide off the screen or pass through the screen, depending upon the size of the obstructing object. The increase in actual spacing is relatively small, so that the object rejection size or tolerance is not significantly changed. The simultaneous increase in slope and spacing of the grizzly bars results in enhanced rolling and sliding of obstructing materials from the screen, quickly and efficiently clearing objects from the screen.

The screen may be pivoted about the pivot axis by a hydraulic cylinder, electric motor or other device capable of lifting the screen. Any of these motive means may be equipped with a remote control device by which an operator may clear obstructions from the screen without leaving a front end loader or other vehicle.

The invention also includes a novel means for attaching the grizzly bars to the screen frame to provide positive retention of the bars, and to allow an operator to remove and quickly replace damaged or worn bars without tools. These and other objects and advantages of the invention will be readily understood by reading the following description in conjunction with the accompanying figures of the drawings wherein like reference numerals have been applied to designate like elements throughout the several views.

DESCRIPTION OF THE PREFERRED EMBODIMENTS

Figure 1:
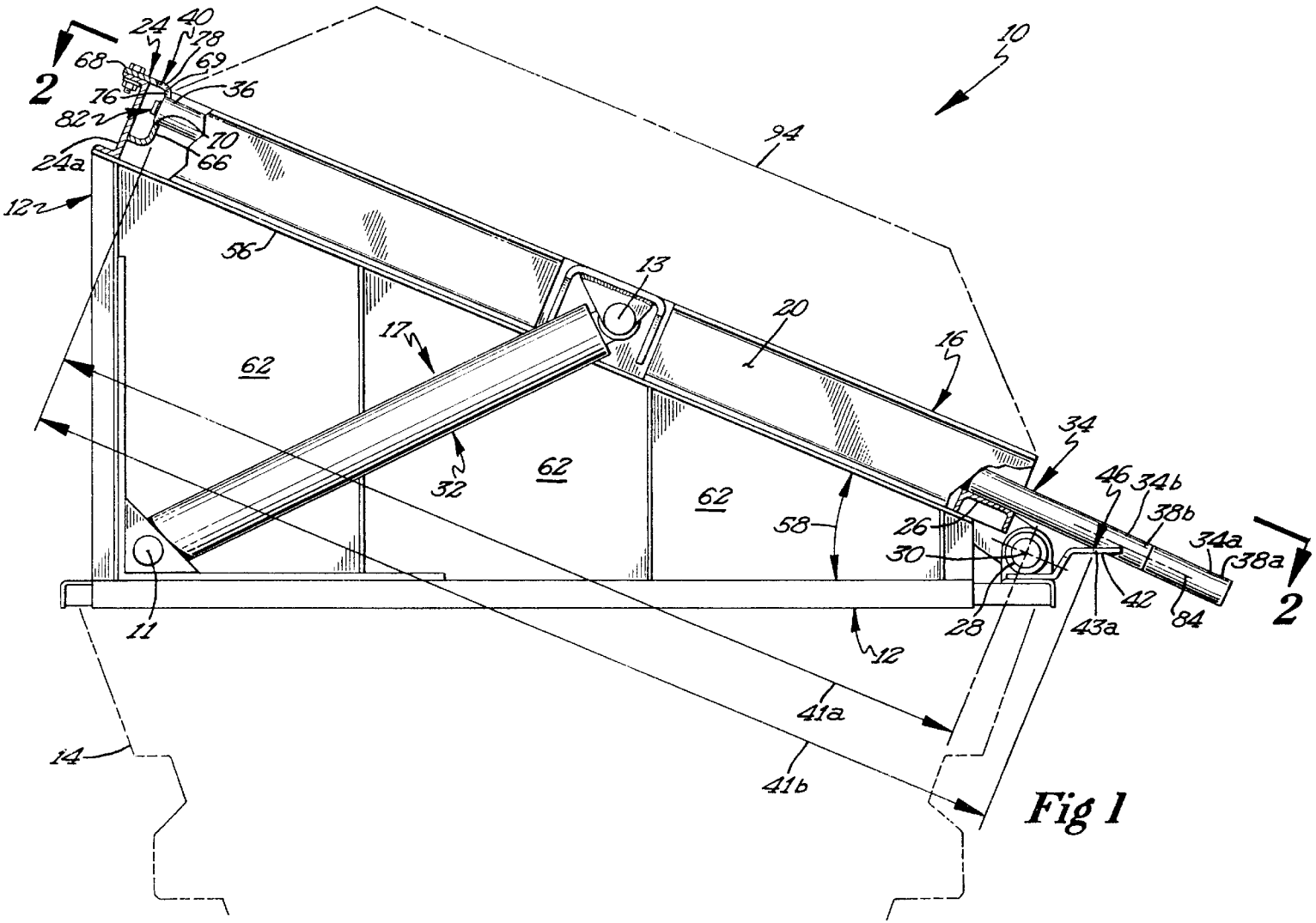
FIG. 1 is a left side view of a grizzly screen apparatus embodying the invention and shown in a sorting position over a receptacle.
Figure 2:
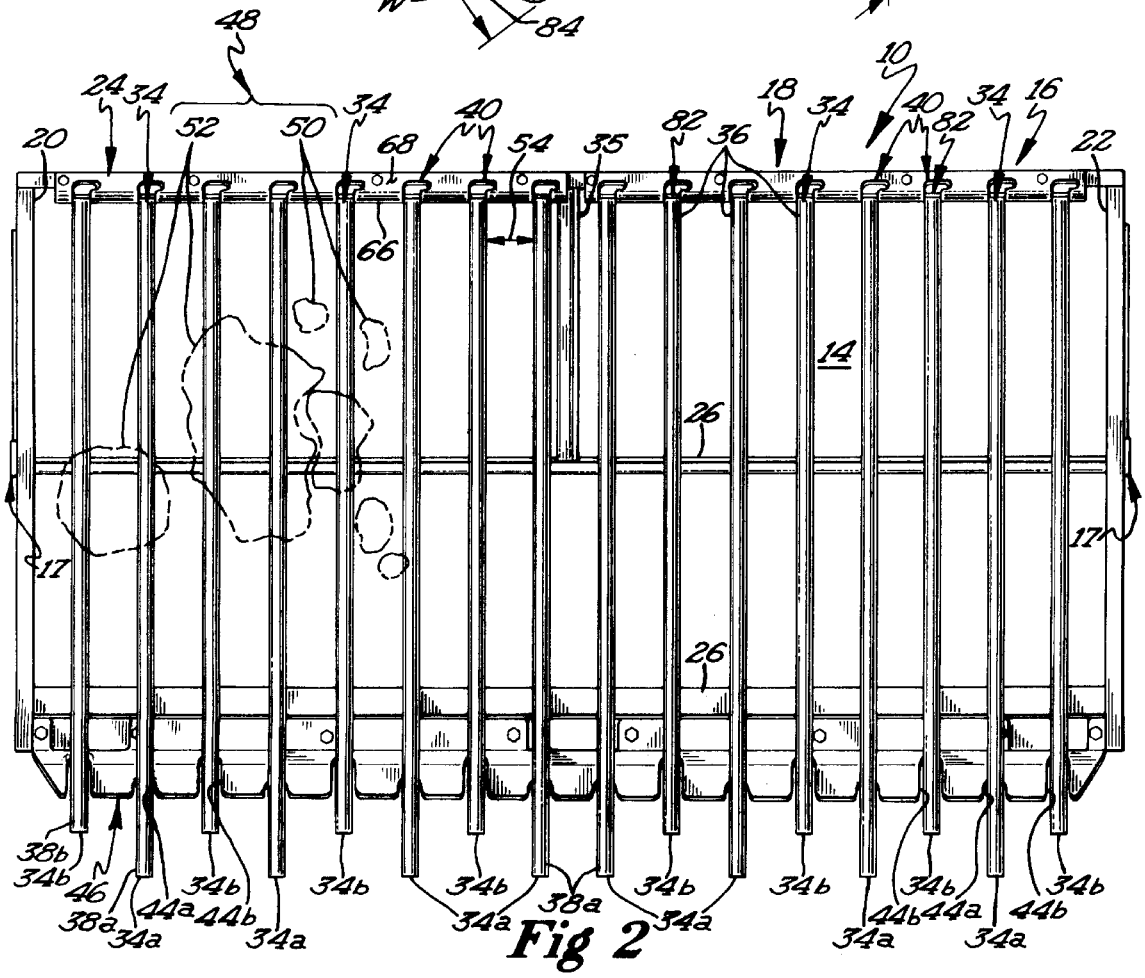
FIG. 2 is a top view of the grizzly screen apparatus shown in FIG. 1 and taken from the direction of arrows 2—2 in FIG. 1.

With reference to the drawings, and particularly to FIGS. 1 and 2, an exemplary grizzly screen apparatus 10, embodying the invention, is shown with a base 12 mounted on a receptacle 14. The grizzly screen apparatus 10 includes a frame 16 in which a grizzly screen 18 is mounted. The frame 16 includes a left side member 20, a right side member 22, a transverse end member 24 fixed to and extending between the side members and one or more cross-arms 26 also extending between the side members and supporting the grizzly bars. A reinforcement member 35 extends between cross-arm 26 and end member 24. The frame 16 is pivotable about a hinge means, here shown as hinge 28 having a transverse horizontal axis 30, by a reversible controllable drive 32, such as a pair of hydraulic cylinders 17 pivotally mounted between axis 11 on the base 12 and axis 13 on the frame 16, with one such cylinder being positioned adjacent each side 20 and 22 of the frame 16.

The grizzly screen 18 comprises a plurality, here shown as sixteen of generally parallel grizzly bars 34 having their first ends 36 supportively mounted in apertures 40 in the transverse end member 24.

Figure 4:
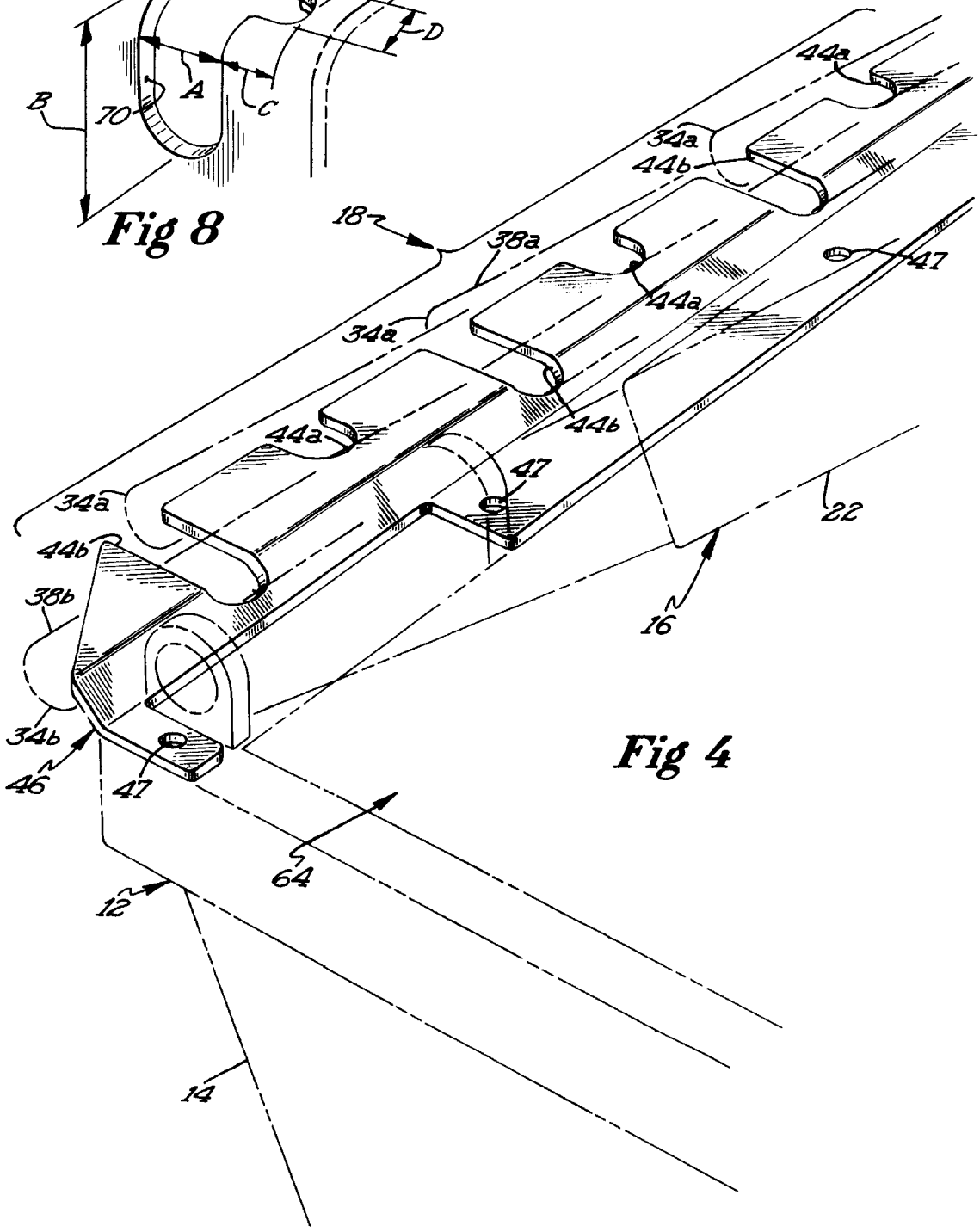
FIG. 4 is a perspective side view of first embodiment of a grizzly bar comb member associated with the grizzly screen apparatus invention.

As shown in FIGS. 1 and 2, the second ends 38 of the grizzly bars 34 are positioned in slots 44*a* and slots 44*b* of a comb member 46. As shown, the slots include alternating shallow bed slots 44*a* and deep bed slots 44*b* for adjacent pairs of grizzly bars where a first bar 34*a* and second bar 34*b* make up each such pair. The comb member 46 comprises a differential fulcrum for lowering the second ends 38*b* of second grizzly bars 34*b* relative to the second ends 38*b* of first grizzly bars 34*a*, when the first ends 36 of the grizzly bars are raised by cylinders 17, as the cylinders pivotally move the screen frame about axis 30. The comb member 46 is shown in FIGS. 1 and 4 as a generally horizontal member attachable to the base 12 with fasteners such as bolts, not shown, passed through apertures 47. It may alternatively be attached by welding or other means which will withstand the high forces placed thereon.

It should be understood that a primary series of grizzly bars, namely bars 34*a* move as a group when the frame 18 is raised and lowered and that the primary bars interact with shallow bed slots 44*a*. Similarly a secondary series of grizzly bars, namely bars 34*b* also move as a group when the frame 18 is raised and lowered.

These secondary bars 34*b* interact with deep bed slots 44*b*. The screen is comprised of alternating primary and secondary bars 34*a* and 34*b*, respectively, except at the center of the screen where two bars 34*a* are adjacent.

Figure 5:
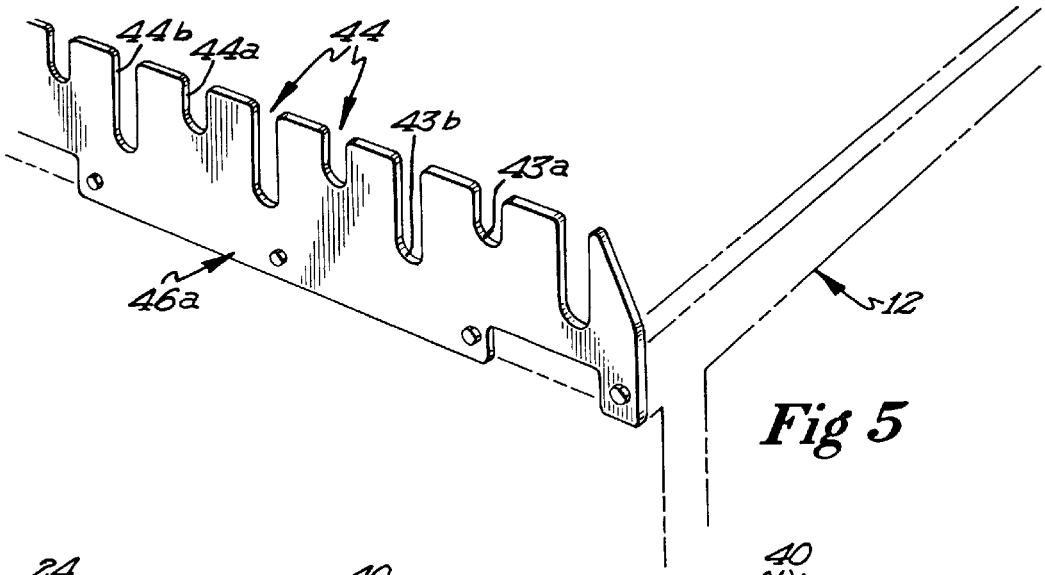
FIG. 5 is a perspective end view of a second embodiment of a comb member useable with the grizzly screen apparatus invention.

An alternate comb member 46*a* is shown in FIG. 5. The comb member 46*a* is shown as being generally planar, with shallow bed and deep bed slots 44*a*, 44*b*, respectively for holding primary and secondary grizzly bars 34*a*, 34*b*, respectively.

The comb member 46 or 46*a* may be either planar or angled in any way which will intersect the grizzly bars 34, providing a retention system when the screen is in sorting position and a differential fulcrum to separate the second ends 38*a*, 38*b* of the bars 34 when the frame is in its raised or clearing position. However, the use of the angled generally horizontal comb member 46 is preferred and generally has less tendency to prevent or retard rocks and the like from discharging from the screen 18.

Figure 6:
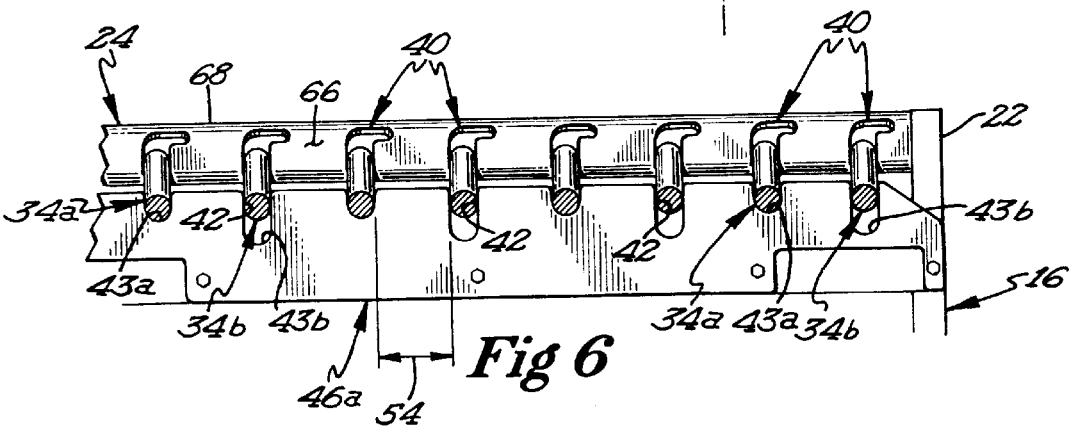
FIG. 6 is a partial diagrammatic front view of the grizzly bar comb member of FIG. 5, wherein the grizzly bars are in a position for screening.
Figure 7:
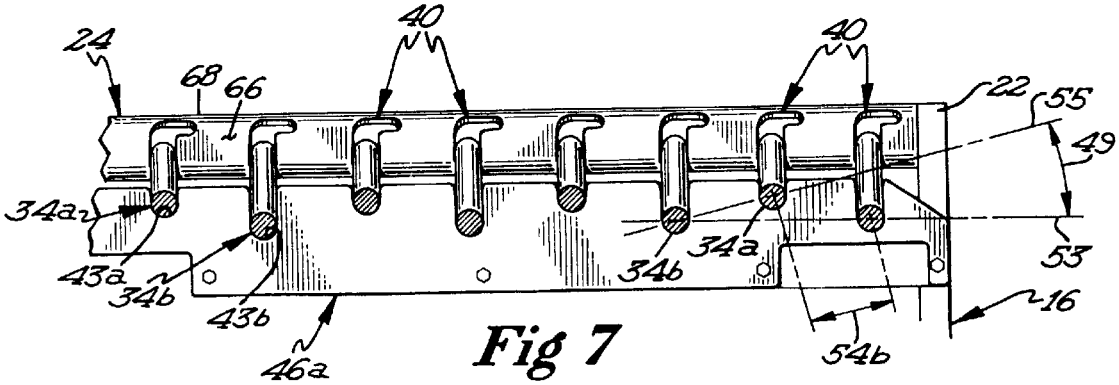
FIG. 7 is a partial diagrammatic front view of the grizzly bar comb member of FIG. 5, wherein the grizzly bars are in a screen clearing position.

As shown in the drawings the comb member is preferably positioned so that the inner ends or beds 43*a* of shallow bed slots 44*a* are off-axis, i.e. are not coincident with pivot axis 30. In addition, with the embodiment shown in FIG. 1, the distance 41*b* from the transverse end member 24 to the slot beds 43*a* should exceed the distance 41*a* from transverse end member 24 to the pivot axis 30. Thus, as illustrated in FIGS. 4, 6 and 7, the second ends 38*a*, 38*b* of the grizzly bars 34*a*, 34*b*, respectively, will drop within slots 44*a*, 44*b*, respectively, to engage the slot beds 43*a*, 43*b*, respectively, and adjacent bars 34*a*, 34*b* will be differentially lowered as the frame 16 is raised. While the horizontal separation distance 54 (FIG. 6) between grizzly bars 34 remains substantially constant, the actual maximum separation distance 54*b* (FIG. 7) between adjacent bars 34 increases as bars 34*b* are lowered relative to bars 34*a*. The actual maximum separation distance 54*b* between the centers of the bars is the product of the horizontal separation distance 54*a* between the centers of the bars and the secant of the angle 49, where angle 49 is the angle shown in FIG. 7 between the plane 53 defined by the center lines of the grizzly bars 34*b* (or alternatively, bars 34*a*) and the longest line 55 connecting adjacent grizzly bars 34*a* and 34*b*.

As shown in FIG. 2, various rock 48 or other objects having mixed sizes is dropped on the grizzly screen 18 and is separated thereby into (a) undersize materials 50 which pass downward in the spaces between the grizzly bars 34, and (b) oversize rocks 52 which roll and slide down the grizzly bars 34 to be discharged from the second ends 38 of the grizzly bars, i.e. outside of the area covered by the screen 18.

Referring now to FIG. 2, it has been found desirable to have primary grizzly bars 34*a* be longer than grizzly bars 34*b* so as to extend further outward from comb member 46 than the bars 34*b*. Such an arrangement allows the operator of a front end loader to place his bucket below the extended bars 34*a* and raise the grizzly bars 34*a* by raising the bucket. Such a movement results in even greater separation between the second ends of the primary and secondary bars and allows the operator to dislodge the most stubbornly jammed obstructions from the screen. Desirable results are obtained when the primary bars 34*a* are about four inches longer than the secondary bars 34*b*.

In FIG. 4, the grizzly screen 18 is shown in a raked or clearing position elevated above the normal operating or sorting position, shown in FIG. 1, in which sorting position all the grizzly bars 34*a*, 34*b* are parallel and substantially coplanar. Referring now to FIG. 1, the angle 58 of the upper edge 56 of base 12 with the horizontal is shown in FIG. 1 as approximately 23 degrees with the screen in the sorting position but may be between about 0 degrees, i.e. no slope and about 35 degrees depending upon the particular characteristics of the material to be sorted and the desired separation size. Typically, angle 58 is between about 15 and 30 degrees to provide the necessary gravitational force to move oversize materials 52 to the discharge ends, i.e. second ends 38 of the grizzly bars 34.

As the screen is moved to the clearing position shown in FIG. 4, the angle between the screen and the base 12 increases, with the screen and bars preferably at an angle of about 75 degrees to the horizontal when the clearing position of FIG. 4 is reached. While an angle of about 75 degrees is preferred in order to permit a sufficient increase in inter-bar opening size and sufficient downward slope of the frame to release jammed obstructions from between the bars, it should be understood that the angle can be further increased or decreased by approximately 15 degrees to meet specific clearing conditions encountered at the work site.

The base 12 is formed to provide a sloped bed for the frame 16 and attached screen 18. The base 12 is shown as having closed sides 62 and dimensionally fits atop the receptacle 14. A downwardly directed opening 64 in the base 12 permits undersize material 50 to fall into the receptacle 14.

The screen 18 is shown as comprising a plurality of parallel, solid metal grizzly bars 34, each of which has a first end 36 retainably held by the transverse end member 24 in a way which permits bar 34 to move in a vertical plane about its first end 36 to some degree but prevents significant longitudinal or lateral movement of the bar. The grizzly bars 34 have a diameter 72 providing sufficient strength to prevent bending during the screening operations, and are spaced apart a distance 54 to define the desired separation size.

During screening operations, the grizzly bars 34 normally rest on the fixed transverse cross-arm(s) 26 and are also laterally restrained, being held in the slots 44*a* and the upper portions 42 (FIG. 5) of slots 44*b* of the comb member 46.

Figure 3:
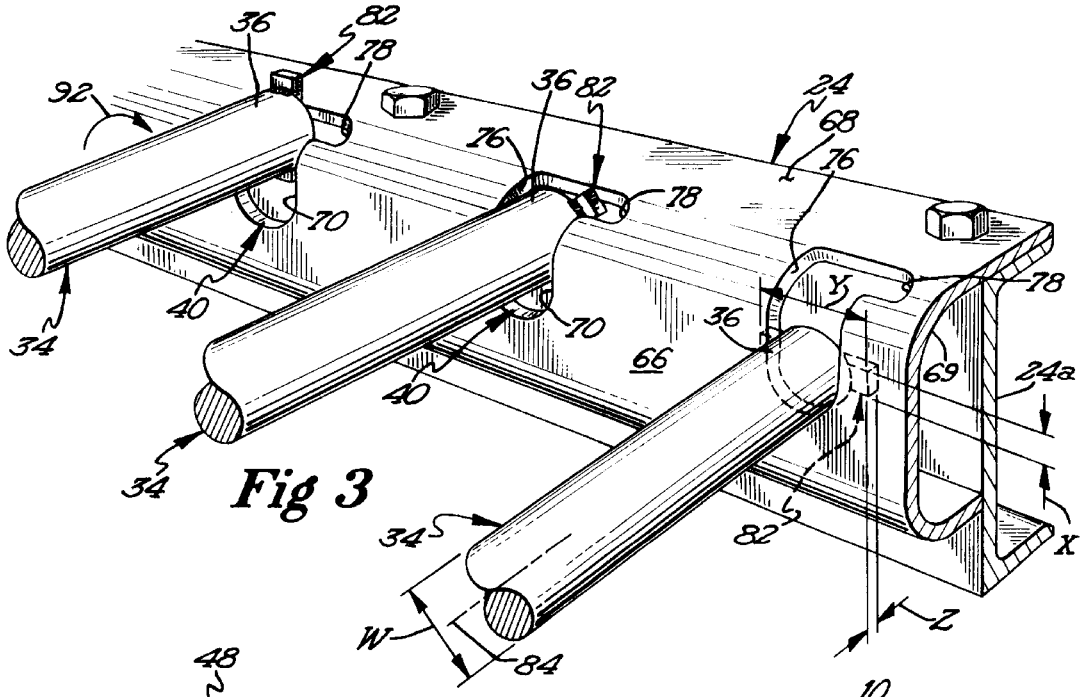
FIG. 3 is a partial perspective side view of a grizzly bar retaining device associated with the grizzly screen apparatus and illustrating the manner in which grizzly bars are inserted in and retained by the screen frame.

Turning now to FIG. 3, each grizzly bar 34 is shown with a lock bar 82 affixed to the first end 36 thereof at a right angle with the bar axis 84. The width X and thickness Z of the lock bar 82 are less than the grizzly bar diameter W, and the lock bar projects from the grizzly bar generally equally in opposite directions, having a typical overall length Y of about 1.2 to 2.0 times the grizzly bar diameter W.

Figure 8:
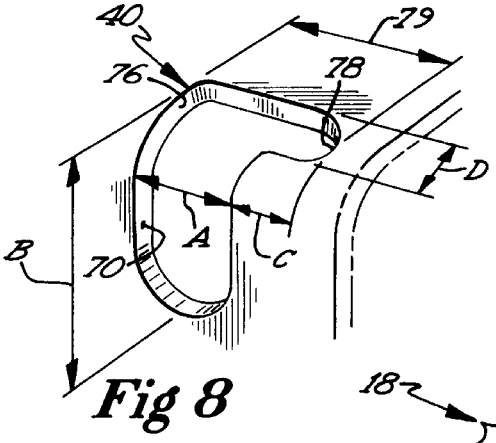
FIG. 8 is a partial perspective view of a transverse end member embodying the invention and showing the configuration of slots that retain the grizzly bars.

The transverse end member 24 is shown as a rigid metal part of the frame 16 and may include a reinforcement member such as channel 24*a*. The transverse end member 24 has a generally flat front 66, a generally flat top 68, and a generally arcuate transition portion 69 between the front and top. The transverse end member 24 has a plurality of inverted L or dogleg-shaped keyhole apertures 40 on its front 66 and transition portion 69, one for each grizzly bar. As best shown in FIG. 8, each of the keyhole apertures 40 is shown with a vertical portion 70 which has a width A slightly larger than the grizzly bar diameter W, and a height B. The width A of the vertical portion 70 is preferably between about 1.01 and 1.2 times the grizzly bar diameter W and is sized so that the grizzly bar 34 may be moved freely up and down within the vertical portion 70 during insertion and removal. A "dogleg" slot 78 projects at about a right angle (either left or right) from the upper portion 76 of each keyhole aperture 40. The width D of slot 78 is less than the grizzly bar diameter W but may be greater than the lock bar width X, or alternatively greater than the lock bar thickness Z. The length C of the dogleg slot 78 is preferably slightly greater than one-half of the lock bar length Y plus one-half of the grizzly bar diameter W, so that when the grizzly bar 34 is at the upper portion 76 and the grizzly bar is rotated clockwise about its axis 84 in direction 92 (FIG. 3) toward the dogleg slot 78, the upper end of the lock bar 82 will pass through the dogleg slot 78.

In the shown embodiment, the width D of slot 78 is greater than the lock bar thickness Z.

Because of the slope of the grizzly bars 34, during operation gravitational forces tend to maintain the grizzly bars in the steepest angle which can be achieved, i.e. parallel to the "fall line", and prevent axial movement of the bars away from the transverse end member 24. Thus, a grizzly bar 34 cannot be simply pulled from the keyhole aperture 40 or released by vibration, heavy loads and the like which are common to grizzly screening operations. Nevertheless, the grizzly bar 34 is easily and quickly removed from the transverse end member 24 by a particular coordinated movement of the bar. No bolts or other fasteners need to be removed. The dogleg slot 78 may project either to the right (as shown) or to the left of the vertical portion 70 of the keyhole aperture 40.

Referring now to FIG. 3, to install a grizzly bar 34 in an aperture 40, the operator first places the bar 34, such as the left-most bar in FIG. 3, in an orientation generally parallel to but slightly above the plane of the screen 18, with the lock bar 82 in the shown generally upright orientation. The grizzly bar is then lowered into vertical portion 70 of the aperture, keeping the lock bar 82 lateral to and confronting the dogleg slot 78. When the grizzly bar nests in the curved bottom of the portion 70 of the slot, the operator rotates the grizzly bar clockwise about the bar axis 84 as illustrated by the center grizzly bar in FIG. 3 to allow the lock bar 82 to be rotated through the dogleg slot 78 and into the chamber between transverse end member 24 and channel 24*a*. Finally the operator pulls the grizzly bar axially toward the comb member 46 or 46*a* to position the lock bar 82 against the rear face of surface 66 as illustrated by the right bar in FIG. 3, and thereby locks the grizzly bar into its operating position. The second end 38 of the grizzly bar is then aligned in an appropriate slot of the comb member 46 or 46*a*. The bars may be easily removed and replaced by reversing this procedure.

In one typical application, the grizzly screen apparatus 10 may be set up for screening soil contaminated with toxic substances. Upwardly projecting shields 94 may be attached to two or three sides of the frame 16 to confine toxic materials to specific areas. A front-end loader may be used to excavate the contaminated soil and dump it on the grizzly screen 18. Undersize materials 50 passing through the spaces 54 between the bars 34 fall into a bin or truck for transport to a treatment/disposal site. Large rocks or other oversize materials 52 are discharged separately for special handling. Any materials which do not pass through the screen 18 and which clog the screen are handled by manually actuating or remotely controlling the hydraulic cylinders 17 to lift the screen 18 to the clearing position, causing the obstructing objects to either pass through the screen or be discharged from the second ends 38 of the grizzly bars 34. The hydraulic system is then manually actuated or remotely actuated to lower the screen 18 to the lower sorting position for continued screening. Remote control systems for hydraulic cylinders and the like are well known in the art.

The invention solves numerous problems presented by the prior art by combining the use of both angular elevation and changing of spacing of the grizzly bars 34. First, an effective apparatus for clearing obstructions from the screen is achieved. Secondly, control of the clearing process may be done by remote control and without manual tools. Thirdly, the grizzly bars are attached without bolts, screws or other fasteners, and may be installed and removed easily and quickly. Downtime is minimized. A single operator in a front-end loader may control the entire operation without leaving the vehicle. The reduction in manual clearing operations enhances safety.

It is anticipated that various changes and modifications may be made in the structure, arrangement, operation and method of construction of the grizzly screening apparatus disclosed herein without departing from the spirit and scope of the invention as defined in the following claims.

What is claimed is:

1. A method for screening an unsorted mixture of discrete objects to separate said objects by general size, comprising:

providing a grizzly screen with generally parallel primary and secondary grizzly bars all having first and second ends, said bars pivotally attached at a first end to a transverse end member, said grizzly screen pivotable about an axis intermediate said first ends and said second ends and spacedly proximate said second end, said primary grizzly bars having a greater length than the secondary grizzly bars;

applying loads of the unsorted mixture of objects onto said grizzly screen to be separated by and discharged from said screen;

stopping the application of said mixture to said screen when oversize objects become retained between the grizzly bars;

raising said transverse end member to elevate said first ends of said grizzly bars and differentially lower said secondary grizzly bar relative to said primary grizzly bar to increase interbar spacing, whereby said retained oversize objects are discharged to clear said screen.

2. A grizzly screening apparatus for separating solid materials according to size, comprising:

a base with a downwardly directed opening;

a frame pivotally mounted on said base, said frame comprising opposing left and right side members connected by a transverse end member;

a screen mounted to said frame, said screen comprising:

A plurality of generally parallel elongate grizzly bars of diameter "W", each said grizzly bar having a first end pivotally attached to said transverse end member for individual movement in a vertical plane, and a second end; said plurality of grizzly bars including primary grizzly bars and secondary grizzly bars, said primary grizzly bars having a greater length than the secondary grizzly bars;

a support for supporting the second ends of said grizzly bars; said support means comprising a comb member mounted on said base and having parallel slots therein; said grizzly bars fitting within said slots for limiting transverse movement of said grizzly bars; and a motive means for pivotally elevating said transverse end member and attached first ends of said grizzly bars relative to said base.

3. The grizzly screening apparatus of claim 2, wherein said support means comprises said base.

4. The grizzly screening apparatus of claim 2, further comprising means for simultaneously elevating the first ends of all grizzly bars and lowering the second ends of alternate grizzly bars relative to the remaining grizzly bars.

5. The grizzly screening apparatus of claim 2, wherein said support means comprises a slotted comb member mounted on said base and having parallel slots therein, said grizzly bars fitting within said slots for limiting transverse movement of said grizzly bars.

6. The grizzly screening apparatus of claim 2, further comprising at least one transverse cross-arm mounted to said left and right side members near said second ends of said grizzly bars.

7. The grizzly screening apparatus of claim 6, whereby said at least one transverse cross-arm comprises support means for said grizzly bars.

8. The grizzly screening apparatus of claim 2, wherein said first ends of said grizzly bars are retainable in transversely spaced retaining apertures in said transverse end member.

9. The grizzly screening apparatus of claim 8, wherein said first end of each said grizzly bar has a transverse lock bar affixed thereto, said lock bar insertable into said aperture to be restrained from removal by other than a predetermined movement of said grizzly bar.

10. A grizzly screening apparatus for separating discrete solid materials according to size, comprising:

a base with a downwardly directed opening;

a frame comprising left and right side members connected by a transverse end member, said frame pivotable about a generally horizontal transverse axis whereby said transverse end member moves between a lower sorting position and a raised clearing position relative to said base;

a screen comprising:

a plurality of primary elongate spaced-apart grizzly bars with first and second ends, said first ends pivotally held by said transverse end member, said primary grizzly bars supported between said first and second ends thereof;

a plurality of secondary elongate spaced-apart grizzly bars with first and second ends, said first ends pivotally held by said transverse end member, said secondary grizzly bars supported between said first and second ends thereof;

differential fulcrum means spaced from said transverse end member, for engaging the primary grizzly bars and elevating the second ends of said primary grizzly bars relative to the second ends of said secondary grizzly bars when said frame is pivoted upwardly from said lower sorting position;

motive means for reversibly pivoting said primary and secondary grizzly bars about said horizontal transverse axis between said lower sorting position and said upper clearing position and pivoting said primary grizzly bars about said fulcrum means to lower the second ends of said secondary grizzly bars relative to the second ends of said primary grizzly bars and to simultaneously elevate the first ends of said primary and secondary grizzly bars relative to said second ends thereof.

11. The grizzly screening apparatus of claim 10, further comprising at least one transverse cross-arm connecting said left and right side members of said frame between said first and second ends of said grizzly bars.

12. The grizzly screening apparatus of claim 11, wherein at least one transverse cross-arm is transverse said primary and secondary grizzly bars near the second ends thereof.

13. The grizzly screening apparatus of claim 11, wherein said at least one transverse cross-arm comprises a support for at least a portion of said primary and secondary grizzly bars when said frame is in said lower sorting position.

14. The grizzly screening apparatus of claim 11, wherein said at least one transverse cross-arm comprises a support for said secondary grizzly bars when said frame is in said lower sorting position.

15. The grizzly screening apparatus of claim 11, wherein said at least one transverse cross-arm comprises a support for said primary and secondary grizzly bars when said frame is in said lower sorting position.

16. The grizzly screening apparatus of claim 10, wherein said primary grizzly bars and secondary grizzly bars are configured to be regularly spaced in an array of approximately parallel bars when said frame is in said lower sorting position.

17. The grizzly screening apparatus of claim 10, wherein said primary grizzly bars and secondary grizzly bars are configured to be alternately positioned in said screen.

18. The grizzly screening apparatus of claim 10, said apparatus configured wherein upward movement of said transverse end member from said lower sorting position engages said second ends of said primary grizzly bars with said fulcrum means and disengages said primary grizzly bars from said transverse cross-arm to diverge the second ends of said primary grizzly bars relative to the second ends of said secondary grizzly bars.

19. The grizzly screening apparatus of claim 10, wherein said differential fulcrum means comprises a slotted comb member having slots with shallow beds for retaining said primary grizzly bars and slots with deep beds for retaining said secondary grizzly bars, said comb member rigidly mounted on said base and extending traversely to said primary and secondary grizzly bars.

20. The grizzly screening apparatus of claim 19, wherein said comb member has alternating shallow bed slots and deep bed slots for accommodating alternating primary grizzly bars and secondary grizzles bars.

21. The grizzly screening apparatus of claim 19, wherein said comb member projects generally horizontally from said base.

22. The grizzly screening apparatus of claim 19, wherein said comb member projects generally upwardly from said base.

23. The grizzly screening apparatus of claim 10, wherein said elongate grizzly bars have a generally circular cross section.

24. The grizzly screening apparatus of claim 10, wherein the length of said primary grizzly bars is greater than the length of said secondary grizzly bars whereby the second ends of the primary grizzly bars extend outwardly from said fulcrum means a distance accommodating lifting singly or collectively by motorized construction machinery.

25. The grizzly screening apparatus of claim 24, whereby the second ends of said primary grizzly bars extend outwardly at least about 4 inches beyond the second ends of said secondary grizzly bars.

26. The grizzly screening apparatus of claim 10, wherein said lower clearing position of said screen comprises an upward angle thereof about said transverse axis of between about 0 and about 35 degrees.

27. The grizzly screening apparatus of claim 10, wherein said lower clearing position of said screen comprises an upward angle thereof about said transverse axis of between about 15 and about 30 degrees.

28. The grizzly screening apparatus of claim 10, wherein said motive means is configured to elevate said screen to an upward angle of 45 degrees to about 60 degrees greater than the angle of said lower position.

29. The grizzly screening apparatus of claim 10, wherein said motive means is configured to elevate said screen to an upward angle of at least about 45 degrees greater than the angle of said lower position.

30. The grizzly screening apparatus of claim 10, wherein said motive means is configured to elevate said screen to an upward angle of at least 75 degrees relative to the horizontal when in raised clearing position.

31. The grizzly screening apparatus of claim 11, wherein said transverse cross-arm is configured to support said primary and secondary grizzly bars in said lower sorting position of said screen.

32. The grizzly screening apparatus of claim 10, wherein said horizontal transverse axis is a distance Q from said transverse end member and said differential fulcrum means is spaced a distance greater than Q from said transverse end member wherein the second ends of said secondary grizzly bars are lowered relative to the second ends of said primary grizzly bars when said frame is pivoted upwardly from said lower sorting position.

33. The grizzly screening apparatus of claim 10, wherein said differential fulcrum means is off-axis relative to said horizontal transverse axis.

34. The grizzly screening apparatus of claim 10, further comprising hinge means attached between said base and said frame whereby said transverse end member is movable between lower sorting and upper clearing positions relative to said base, and correspondingly the second ends of said primary and secondary grizzly bars are movable downwardly about said transverse axis until engagement with said fulcrum means, and reversibly movable upwardly from said fulcrum means.

35. A grizzly screening apparatus for separating solid materials according to size, comprising:

a base with a downwardly directed opening;

a frame pivotally mounted on said base, said frame comprising opposing left and right side members connected by a transverse end member;

a screen mounted to said frame, said screen comprising:

A plurality of generally parallel elongate grizzly bars of diameter "W", each said grizzly bar having a first end pivotally attached to said transverse end member for individual movement in a vertical plane, and a second end;

said screen being strong enough to separate concrete debris;

a support for supporting the second ends of said grizzly bars; said support means comprising a comb member mounted on said base and having parallel slots therein; said grizzly bars fitting within said slots for limiting transverse movement of said grizzly bars;

a motive means for pivotally elevating said transverse end member and attached first ends of said grizzly bars relative to said base; and said slots being alternately shallow and deep for holding alternate grizzly bars, whereby elevation of said first ends of said grizzly bars diverges the second ends of alternate grizzly bars from the second ends of the remaining grizzly bars to increase the distance between the second ends of the alternate grizzly bars.

36. A grizzly screening apparatus for separating solid materials according to size, comprising:

a base with a downwardly directed opening;

a frame pivotally mounted on said base, said frame comprising opposing left and right side members connected by a transverse end member;

a screen mounted to said frame, said screen comprising: a plurality of generally parallel elongate grizzly bars of diameter "W", each said grizzly bar having a first end pivotably attached to said transverse end member for individual movement in a vertical plane, and a second end;

said screen being strong enough to separate concrete debris;

a support for supporting the second ends of said grizzly bars; and motive means for pivotally elevating said transverse end member and attached first ends of said grizzly bars relative to said base;

said first ends of said grizzly bars being retainable in transversely spaced retaining apertures in said transverse end member;

said first end of each said grizzly bar having a transverse lock bar affixed thereto, said lock bar insertable into a said aperture to be restrained from removal by other than a predetermined movement of said grizzly bar; and said lock bar having a width "X", a thickness "Z", and a length "Y", said transverse end member including a generally flat front face, a generally flat top and an arcuate transition portion between said front and top, each said aperture in the transverse end member having an inverted L-shape and comprising;

a generally vertical aperture portion having a width "A" and height "B" extending between a lower portion and an upper portion;

a generally horizontal aperture portion extending from one side of the upper portion of said vertical aperture portion and having a length "C" and width "D";

wherein:

"A" is about 1.01–1.2 times "W",

"B" is about 1.2–2.0 times "W", and less than about "Y".

"C" is greater than about 0.5("Y"+"W")–"A",

"D" is greater than the smaller of "X" and "Z".

37. A grizzly screening apparatus for separating solid materials according to size, comprising:

a base with a downwardly directed opening;

a frame pivotally mounted on said base, said frame comprising opposing left and right side members connected by a transverse end member;

a screen mounted to said frame, said screen comprising a plurality of generally parallel elongate grizzly bars of diameter "W", each said grizzly bar having a first end pivotably attached to said transverse end member for individual movement in a vertical plane, and a second end;

support means for supporting the second ends of said grizzly bars, said support means comprises said base, said support means further comprises a slotted comb member mounted on said base and having parallel slots therein, said grizzly bars fitting within said slots for limiting transverse movement of said grizzly bars, said slots are alternatively shallow and deep for holding alternative grizzly bars, whereby elevation of said first ends of said grizzly bars diverges the second ends of alternate grizzly bars from the second ends of the remaining grizzly bars to increase the distance between the second ends of alternate grizzly bars;

motive means for pivotally elevating said transverse end member and attached first ends of said grizzly bars relative said base; and means for simultaneously elevating the first ends of all grizzly bars and lowering the second ends of alternate grizzly bars relative to the remaining grizzly bars.

38. The grizzly screening apparatus of claim 37, further comprising at least one transverse cross-arm mounted to said left and right side members near said second ends of said grizzly bars, said at least one transverse cross-arm comprises support means for said grizzly bars;

said first ends of said grizzly bars are retainable in transversely spaced retaining apertures in said transverse end member, said first end of each said grizzly bar has a transverse lock bar affixed thereto, said lock bar insertable into said aperture to be restrained from removal by other than a predetermined movement of said grizzly bar, said lock bar has a width "X", a thickness "Z", and a length "Y";

said transverse end member includes a generally flat front face, a generally flat top and an arcuate transition portion between said front and top; and each said aperture in the transverse end member having an inverted L-shape and comprising:

a generally vertical aperture portion having a width "A" and height "B" extending between a lower portion and an upper portion, and a generally horizontal aperture portion extending from one side of the upper portion of said vertical aperture portion and having a length "C" and width "D", wherein:

"A" is about 1.01–1.2 times "W",

"B" is about 1.2–2.0 times "W", and less than about "Y",

"C" is greater than about 0.5("Y"+"W")–"A",

"D" is greater than the smaller of "X" and "Z".

* * * * *